US009501900B2

(12) United States Patent
Luciano, Jr. et al.

(10) Patent No.: US 9,501,900 B2
(45) Date of Patent: Nov. 22, 2016

(54) GAMING SYSTEM AND METHOD COMBINING RNG-BASED MACHINES AND HYBRID FINITE POOL-BASED MACHINES

(71) Applicant: JKT Gaming, Inc., Sequim, WA (US)

(72) Inventors: Robert A Luciano, Jr., Reno, NV (US); Warren R White, Reno, NV (US); William K Bertram, Reno, NV (US)

(73) Assignee: JKT Gaming, Inc., Sequim, WA (US)

( * ) Notice: Subject to any disclaimer, the term of this patent is extended or adjusted under 35 U.S.C. 154(b) by 0 days.

(21) Appl. No.: 14/170,406

(22) Filed: Jan. 31, 2014

(65) Prior Publication Data

US 2015/0221174 A1 Aug. 6, 2015

(51) Int. Cl.
*G07F 17/32* (2006.01)

(52) U.S. Cl.
CPC ..... *G07F 17/3258* (2013.01)

(58) Field of Classification Search
CPC ..... G07F 17/3258
See application file for complete search history.

(56) References Cited

U.S. PATENT DOCUMENTS 5,324,035 A 6/1994 Morris et al.
6,866,584 B2 3/2005 Michaelson
6,988,946 B2 1/2006 Michaelson et al.
7,291,069 B2 11/2007 Michaelson et al.
7,775,875 B2 * 8/2010 Nguyen et al. ..... 463/22
8,376,843 B2 * 2/2013 Nguyen et al. ..... 463/29
8,591,325 B2 11/2013 Delaney et al.
9,349,244 B2 * 5/2016 Weingardt ..... G07F 17/3223
2005/0096130 A1 * 5/2005 Mullins ..... 463/27
2005/0261058 A1 * 11/2005 Nguyen et al. ..... 463/40
2006/0052159 A1 * 3/2006 Cahill et al. ..... 463/27
2006/0287077 A1 * 12/2006 Grav et al. ..... 463/27
2008/0020830 A1 1/2008 Ikehara et al.
2008/0020831 A1 * 1/2008 Ikehara et al. ..... 463/27
2009/0325715 A1 * 12/2009 Kelly et al. ..... 463/42
2012/0083331 A1 * 4/2012 Carpenter et al. ..... 463/25
2016/0117884 A1 * 4/2016 Weingardt ..... G07F 17/3223 463/19
2016/0240042 A1 * 8/2016 Weingardt ..... G07F 17/3225

* cited by examiner

*Primary Examiner* — Corbett B Coburn
(74) *Attorney, Agent, or Firm* — Marc D. Foodman; Ferdinand IP

(57) ABSTRACT

A linked gaming system and method combines electronic gaming machines ("EGMs") of different types, each of which is eligible to win a linked jackpot award. One or more first groupings of EGMs each utilize a random number generator to determine game outcome, while one or more second groupings of hybrid EGMs draw outcomes from a finite pool of outcomes determined by a central finite pool system and utilize a jackpot selector to determine jackpot awards. The EGMs from all groupings are configured to have an equal chance of winning the linked jackpot award on the linked gaming system and method.

19 Claims, 10 Drawing Sheets

610

| PRIZE TYPE | PROBABILITY |
|---|---|
| Progressive #1 | .00001 |
| Progressive #2 | .0001 |
| Progressive #3 | .001 |
| $50 | .01 |

FIG. 6B

600

WAP SELECTOR TABLE

| PRIZE TYPE | PROBABILITY |
|---|---|
| Prize 1 Type | Probability 1 |
| Prize 2 Type | Probability 2 |
| • • • | |
| Prize n Type | Probability n |

FIG. 6A

GAMING SYSTEM AND METHOD COMBINING RNG-BASED MACHINES AND HYBRID FINITE POOL-BASED MACHINES

COPYRIGHT INFORMATION

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Electronic gaming machines ("EGMs") offer players a variety of games such as slot games, video poker games, roulette games, keno games, lottery games like Powerball, and other types of wagering games that are commonly deployed at a casino, other gaming venues or at home on the internet. EGMs may be of many types, from traditional "slot machines" to networked computing devices that perform equivalent functionality using functions on the networked computing device interactively coordinated with functions on a host server. Some examples of networked computing devices include but are not limited to a personal computer, a smartphone, a tablet computer, or any computing device which can be integrated into another device, such as eyeglasses, automobiles, and others.

Play on the EGMs typically requires the player to place a wager on the outcome of a primary game. On many such EGMs, additional prizes in the form of progressive prizes or bonus prizes are also available that offer the player an opportunity to win a prize that is separate from the prize awarded for winning the base or primary game. A progressive game is one in which a prize has an increasing value as a function of the play on one or more EGMs and may be won by a player on one or more EGMs. In some cases, the player is eligible for a chance to win the progressive game or bonus game after qualifying for the progressive or bonus round. In other cases, the progressive game win is integrated into the base game. This chance to win is achieved by hitting a certain winning combination or event on or related to the base or primary game, although it may also be achieved based on another criteria such as the amount of play, elapsed time, number of games played, a random event or any other criteria set by the system. If the game is a progressive game, the player may have an opportunity to win extra game credits, game tokens or other awards, including but not limited to a very large cash prize that may be in the millions of dollars. Given the large lottery-style jackpots that have been seen in recent times by combining multiple states' games into combined large jackpot games, it is reasonable to project that progressive gaming prizes could grow by integration and have prizes rise to those same levels or exceed them. A billion dollar progressive is a realistic possibility in a large scale or worldwide network.

Progressive jackpots are well known in the art and are commonly funded by allocating a portion or portions of each bet on one or more EGMs into one or more progressive prizes that are incremented until they are won. The amount of the prize may be increased as a function of play, elapsed time, or another mechanism. An example of a prior art progressive system is disclosed in United States Patent Publication No. 2006/0142079A1 assigned to IGT® entitled "Universal Progressive Game Pool" which is incorporated by reference in its entirety herein.

EGMs are available in many different forms. One common form of EGM is a machine that is microprocessor based and individually generates random number numbers using a hardware or software random number generator ("RNG") to provide random numbers that map to winning and losing outcomes for a particular game. These RNG-based EGMs are deployed in many legalized gaming jurisdictions throughout the United States and the rest of the world, including the state of Nevada. Many jurisdictions require that the probability of a win on any given play of the game is the same. RNG-based EGMs are regularly networked together in progressive systems in a single jurisdiction such as Nevada. Megabucks is one such system that is owned and operated by IGT® of Las Vegas, Nev. Such systems with progressive prizes have been operating for many years and it is not uncommon for the top prize to reach into the tens of millions of dollars.

A second common form of EGM is a machine that is microprocessor based, but that is connected to a network with other EGMs. The system includes a central server that generates and distributes game outcomes from a finite pool of outcomes. Each outcome specifies whether the player wins or loses, and how much the player is awarded in the case of a win. The probability of a win on any given play of the game changes with every play as the pool of outcomes is depleted. For each game played on any of the EGMs on the network, the game outcome is distributed to the individual EGMs that participate on a given game whose pools are on the central server. Like RNG-based EGMs, finite pool type EGMs are also deployed in a number of legalized gaming jurisdictions throughout the United States and the rest of the world, including tribal gaming in the state of Washington. An example of a finite pool system is disclosed in U.S. Pat. No. 7,775,875 assigned to IGT® entitled "Gaming Methods and System" which is incorporated by reference in its entirety herein.

A third form of EGM incorporates a networked computing device and a computer server. It may replicate functions of an RNG-based system or a finite pool based system. Such a system may be implemented as a client-server system in which the networked computing device client has functionality that displays gaming results generated by the server, which controls gaming and accounting functionality. The client device may be a personal computer, smartphone, tablet computer, entertainment gaming system like an XBOX® gaming system from MICROSOFT, wearable glasses like GOOGLE® GLASS device, or a processing element integrated into another device, such as an automobile or any other device which has the capability to support comparable functions.

A fourth type of EGM is a hybrid EGM which uses any of the aforementioned device configurations and combines elements of finite pool based EGMs and RNG based EGMs. Finite pool systems can be configured in many ways, depending on:

(a) The type of wagering games with which they are being used (e.g. various slot game themes, keno, etc.);
(b) Restrictions placed by jurisdictional regulations; and
(c) Technological capabilities and preferences of the manufacturer of the system.

Variations in pools can be by the size of the pools, number of pools open at one time, and the content of each pool element. In some jurisdictions (e.g. charitable gaming in Minnesota), finite pools are used in electronic implementations of pull-tab systems. In those systems, pool sizes are limited to 7500 elements. In other applications (e.g. Washington state tribal gaming, which is based on electronic implementations of lottery scratch tickets) pools sizes may be many millions. In some systems the pool sizes could be billions, or even higher. The content of each element of a finite pool (also called a game set) is the result of a single wager. That content may include, but is not limited to, a specification of win or loss, an amount of the prize, a graphic representation of the result of a play, a coded representation of the graphic result of a play, a unique identification for the play element, or a combination of those elements.

Finite pools may be used in conjunction with EGMs which simulate the play of casino slot machines (although they can be used with other wagering game types, including keno, bingo, pull-tabs, card games and others). One objective of the finite pool is to have a predetermined set of player results in terms of winning amounts. In such a game the player typically has the choice of the amount to bet on each play. One finite pool is generally required for each play denomination to have a deterministic amount of the prizes played and prizes won in each play denomination.

One or more EGMs may place wagers and retrieve results from a prize pool. As a pool is completely exhausted, a new pool is opened which allows play to continue. This is preferably an automated process transparent to the player. In a modified implementation, multiple pools are overlapped as one or more pools are depleted.

A group of RNG-based EGMs or a group of finite pool based EGMs may be connected to a progressive system or other bonus system that offers players the opportunity to win a bonus prize such as a progressive prize. The experience of operators and manufacturers of EGMs is that larger prizes, particularly progressives that grow over time, attract players. The larger the prize, the more players are attracted to it. The same phenomenon occurs with a large fixed prize, but the appeal seems even greater with a progressive prize that is continually building attracting more and more players as it grows. Accordingly, in traditional RNG-based EGM gaming venues, wide area progressive ("WAP") systems have been established to link various gaming machines in different gaming venues (like casinos) to create a pooled prize with an incrementing prize value that may be in the millions or tens of millions of dollars.

One of the most successful large-scale networked bonus prize games that is in the form of a progressive, is Megabucks®, which was established in 1986 by IGT® of Las Vegas, Nev. While linked systems offering large prizes such as progressives have been in place for several years, they were principally limited to networks of EGMs within a single gaming establishment. Megabucks® established the concept of a prize that grew progressively larger as a portion of every wager was added to a fund that funded the jackpot prize for EGMs linked across multiple gaming establishments within a jurisdiction. The increasing prize value was displayed in real-time on a display over the EGMs connected to the Megabucks® WAP system.

The high prize values and the compelling display signage were popular with players, and Megabucks® became a standard offering in most casinos in Nevada. Soon Megabucks® was offered in other gaming jurisdictions and new wide area progressive game systems were offered by IGT® and other manufacturers. In the future it is anticipated that the size and scope of large-scale, networked bonus systems will increase significantly as the operators of these systems and regulators in different jurisdictions around the country and world come together to integrate more EGMs into larger and larger networks to offer much larger prizes and increase public interest and revenue. These large scale systems may be configured to provide large awards in the form of progressive jackpots or fixed jackpots.

In operation, the larger the jackpots, the more public interest is garnered and the more play results. It follows that the more EGMs and the more casinos that are linked together in these systems, the higher the prizes can be and the more successful the systems will be in generating revenues for the operators.

Accordingly, there is increasing interest in having large-scale networked bonus systems that cross jurisdictional boundaries. However, the linking of player devices in RNG-based gaming jurisdictions and those in finite pool based jurisdictions has not been implemented for three reasons:

(a) Many jurisdictions have legal prohibitions preventing linking games across jurisdictional boundaries;

(b) Finite Pools are limited in size and may not be able to support the very low probabilities of a jackpot win that are required of each machine in a large-scale networked bonus system; and (c) The mathematical differences between RNG based gaming systems and finite pool based gaming systems raise questions as to whether all players across a network will have equal opportunities to win on any given play.

In view of the limitations described above, the operation of a particular linked system has been typically limited to EGMs within the physical boundaries of a particular legalized gaming jurisdiction or a grouping of casinos (e.g. interstate networks of tribal gaming casinos). Such systems have been limited exclusively to either all RNG-based EGMs or all finite pool based EGMs. In a linked system with either type of EGM, the amount of the prize offered is often funded by a portion of the wagers placed on EGMs in the system, and the prizes are awarded depending on any number of possible criteria including an outcome of the base game determined by the RNG on an RNG-based EGM, or alternatively in the case of a linked system with finite pool based EGMs connected to it, the game outcome of the base game determined by the RNG of the central server that delivers game outcomes to the EGMs. It is also possible that the funding of the big prize may be as a portion of prizes won or another formula. Alternatively, for either an RNG-based or finite pool based network of EGMs, linked prizes on linked systems may be awarded based on a coin-in value, number of plays or other criteria set by the system.

As discussed above, a connection of mixed groupings of RNG-based EGMs and finite pool based EGMs together on single linked system has never been done. This is because the two different types of EGMs operate in a fundamentally different manner limiting the ability to offer to all players an equal probability of winning a common jackpot prize to any given RNG-based EGM or finite pool based EGM connected to the same linked system. An underlying principle of a gaming system with RNG based EGMs is that the probability of winning any prize is the same on every play. On the other hand, the probability of winning any prize on a finite pool based gaming system changes on every play as the pool from which the plays are chosen is depleted. As a consequence, players in a gaming system with RNG based EGMs and players in a gaming system with finite-pool based EGMs will generally not have equal opportunities to win the jackpot at any given point in time. Details of the degree of difference will depend on many of the particulars of the finite-pool implementations (e.g. sizes of pools). Any inequity will raise questions of the fairness and integrity of the system which impact the viability of the system as a whole.

As an example, assume that there are three gaming venues A, B and C with EGMs participating in a linked game network, Venues A and B have finite pool based EGMs and venue C has RNG based EGMs. At the start of play, $T_1$, all three have nominally the same percentage chance overall of achieving a win of the linked prize on the first play. But at a later time, $T_2$, after a number of plays and where venue A has experienced a number of jackpot hits from its finite pools since $T_1$, the percentage chance of achieving a win of the linked prize at venue A is reduced for the next play. In venue B at time $T_2$, where no jackpot winners have been selected from the open pools since $T_1$, the percentage chance of achieving a win of the linked prize is increased for the next play. The result is that during a time of a high jackpot interest, the players at the three venues have different probabilities of winning the prize at any given point in time. Players at venue B have the best chance, players at venue A have the worst chance, and players at venue C have a likelihood of winning that is somewhere in between the chances at venue A and venue B.

There is a need for a solution that will enable finite-pool based gaming systems to operate on the same jackpot system with RNG based EGMs and allow all players to have statistically equal chances of winning prizes at all points in time.

The present invention is directed to large-scale linked bonus gaming systems, including but not limited to systems that offer progressive jackpots or large fixed prizes, and methods that combine RNG-based EGMs with hybrid finite pool based EGMs. A hybrid finite pool based EGM is one that includes a randomizing element offering players utilizing either type of EGM an equal opportunity of winning a common jackpot. The result is a linked system that is mathematically equitable to all parties and preserves principles of fairness.

BRIEF DESCRIPTION OF THE DRAWINGS

For a better understanding of the present invention, and to show more clearly how it functions, reference will now be made, by way of example, to the accompanying drawings. The drawings show embodiments of the present invention in which:

FIG. 6A shows the basic structure of a WAP jackpot selector table;

FIG. 6B shows a sample WAP jackpot selector table;

DETAILED DESCRIPTION OF THE INVENTION

Figure 1:
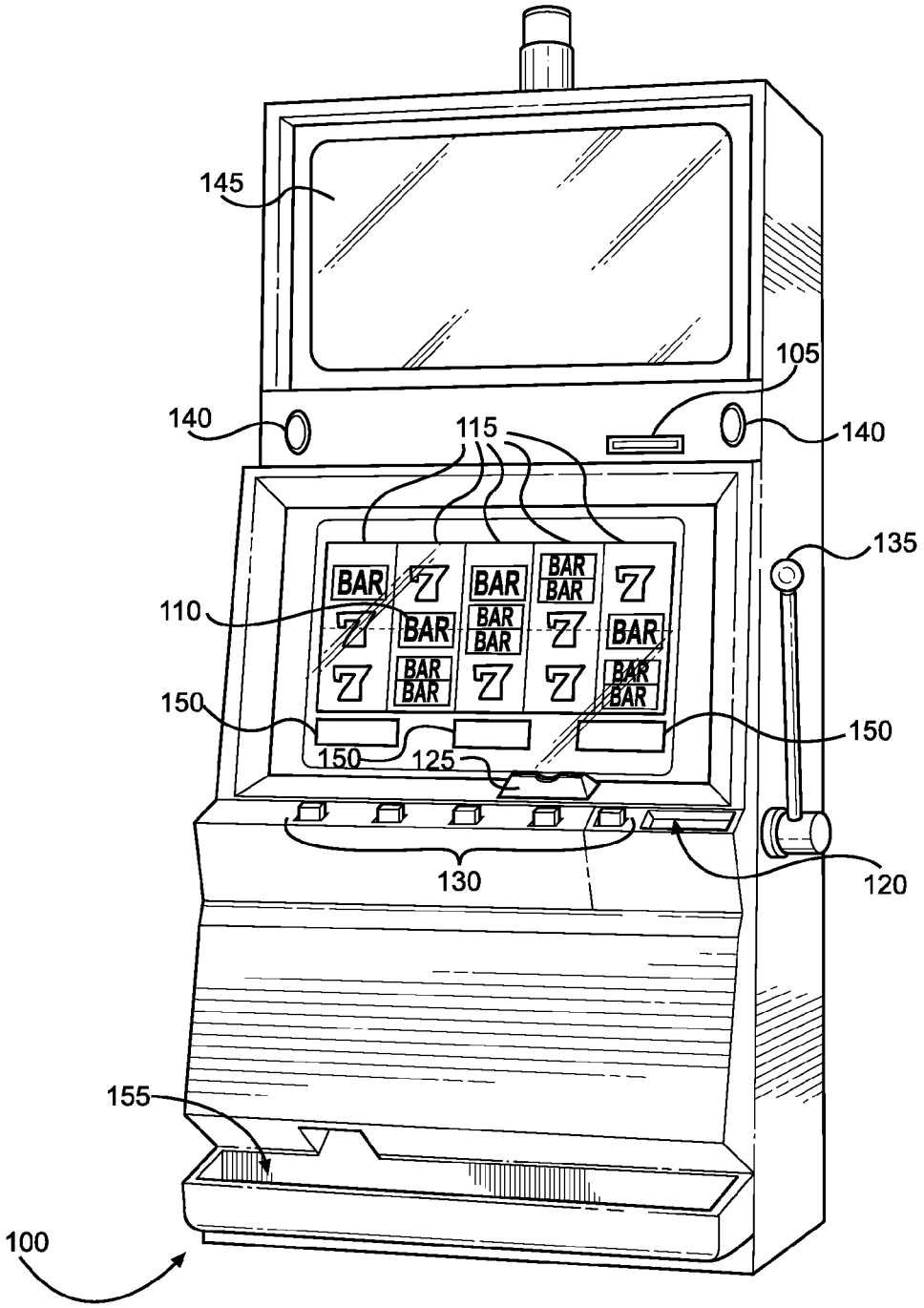
FIG. 1 Prior Art
FIG. 1 shows a prior art microprocessor based electronic gaming machine.

The present invention will now be described more fully with reference to the accompanying drawings. It should be understood that the invention may be embodied in many different forms and should not be construed as limited to the embodiments set forth herein. Throughout FIGS. 1-10, like elements of the invention are referred to by the same reference numerals for consistency purposes.

FIG. 1 shows a prior art microprocessor based EGM 100 that may be of any type described above: (1) RNG based; (2) Finite-pool based; or (3) hybrid based. EGM 100 is a wagering device that is used in a casino or other gaming venue and may be configured to display and play any of a number of different types of games, including but not limited to electromechanical spinning reel type slot games, video reel games, video poker, keno, roulette, craps, blackjack, lottery or any other type of wagering game.

Figure 2:
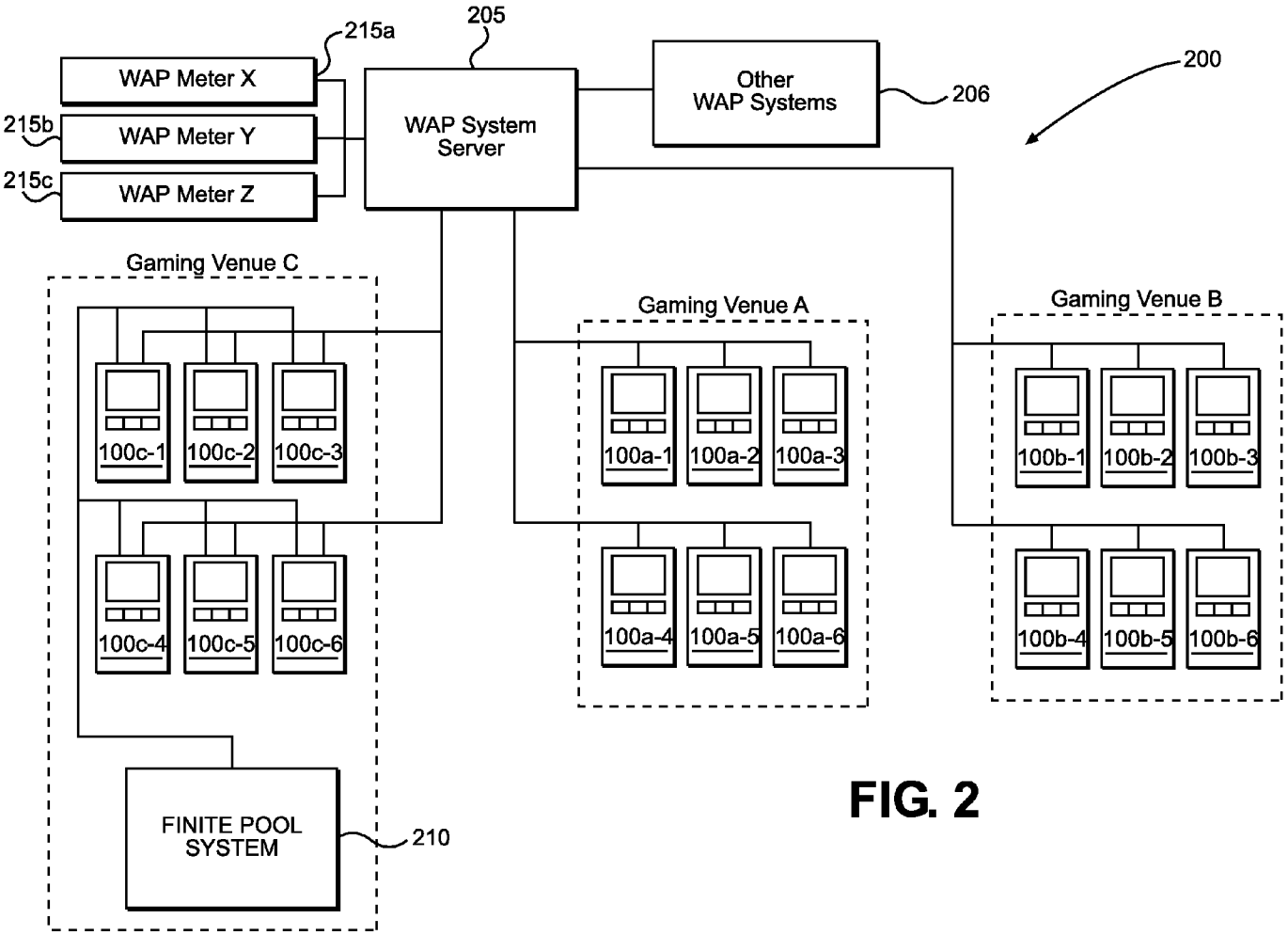
FIG. 2 is a block diagram of a wide area progressive system with optional links to additional wide-area progressive systems, configured in a network with a combination of banks of RNG-based and finite pool based EGMs.

FIG. 2 is a block diagram of a large-scale, multi-venue system, linked gaming system 200 offering a large jackpot in the form of a progressive jackpot. It should be understood that while the linked system is represented as a progressive given the popularity and success of progressive systems, the system could be any linked system with one or more prizes available to a player playing at an EGM in any of the venues in which EGMs are connected to system 200.

In the sample configuration of FIG. 2, system 200 includes optional links to additional wide-area progressive systems and is set up with multiple banks or groupings of EGMs 100 connected to a WAP system server 205. In the example configuration of FIG. 2, EGMs 100 at three different gaming venues, A-C are shown where gaming venue A and gaming venue B are operations with RNG-based EGMs, while gaming venue C is an operation with finite pool based EGMs with multiple EGMs drawing outcomes from finite pool system 210. Note that the "system" may be a single server, or a hierarchical system of servers, possibly including intermediary controlling devices, depending on the technological solution implemented by the a system supplier. In system 200, WAP system server 205 tracks play on each EGM 100 from each bank at gaming venues A, B and C. One or more prizes, in this case progressive prizes, may be set up where a portion of an amount wagered is used to fund each progressive and a progressive meter for each progressive prize X, Y or Z 215*a-c* that displays the current level of the progressive is incremented as more games on EGMs connected to WAP system server 205 are played.

System server 205 is configured with a database system and one or more server computers to collect and process data from the multiplicity of EGMs 100 in the connected facilities. The role of system server 205 is to collect data concerning play at EGMs 100 and consolidate the data to calculate large composite prizes and perform associated accounting and control functions. Those prize values are distributed over the network to participating EGMs 100 and supportive meter display points such as WAP meters X, Y and Z 215*a-c* which may be replicated one or more times at each gaming establishment where EGMs 100 are located and where the real-time value of the new prize may be displayed. The real-time display meters 215 may be configured with software that will display the prizes in a real-time incrementing meter format so they appear to be always incrementing, when in fact the prize value is actually distributed in more infrequent time intervals. Prior art WAP system products that perform the roles for dedicated RNG-based groups of EGMs as described are supplied by IGT®, Bally Technologies, Inc. and other manufacturers of gaming equipment. Some implementations of the system will also include a site controller or concentrator (see FIG. 4) that distributes system functionality and integrates communication from a multiplicity of devices and prepares it for communications to the central site in an altered format, or using an alternative communication methodology.

Network connectivity may be implemented in any of several different ways that support connection of large numbers of EGMs 100 to system server 205. A typical network might include a Local Area Network ("LAN") within a gaming facility and a Wide Area Network ("WAN") that connects the multiplicity of gaming facilities to system server 205. In a preferred implementation the LAN might be an Ethernet configuration and the WAN might be a secure internet connection.

Regardless of the method of connectivity, each manufacturer of system 200 will have a defined interface to EGMs 100 within a gaming venue. Such an interface will define message content critical to the operation of system server 205. Content of such messages includes: play data from every EGM 100, and the case of a progressive system further including data sufficient to calculate increments to new consolidated prizes, prize values for display on EGMs 100 and/or auxiliary display devices, notifications of jackpot winning events at an EGM 100, notification of exact winning prize values in the event of a jackpot winning event, and other information as may be required as per a specific manufacturer's central system implementation.

In most cases, EGMs 100 in a gaming establishment are also connected to systems for player tracking so that the casino can track the amount of play by each individual player. In that case, the system has a method for uniquely identifying a player. For example, each player is issued a player tracking device such as a card that is inserted into a card slot 105 on EGM 100 during play. The card identifies the player to the system and all wagered amounts are tracked for loyalty rewards and other marketing programs of the casino. Other systems may also be connected to EGMs 100 for accounting purposes so that a casino operator can monitor and track play, and assess performance of EGMs across the entire casino floor.

Each EGM 100, regardless of whether it is an RNG-based EGM 100*a* or a finite pool based EGM 100*c* has a number of components. A display 110 is used to show game play and resulting outcomes, and may be in the form of a video display (shown), or alternatively, physical reels. In some implementations, multiple displays, devices and touch screens are used to reflect different aspects of game play and information. Touch screen displays are included on most EGMs and provide a flexible interface for operation of EGM 100, including displaying symbols 115 during play.

Other components of EGM 100 include a bill validator and a coin acceptor that are both housed inside EGM 100 into which bills may be inserted through bill slot 120 and coins may be inserted through coin head 125, respectively. Buttons 130 on the exterior of EGM 100 are used to control certain EGM operations in conjunction with touch screen display 110. A handle 135 may be used to initiate play of a game and speakers 140 are used to provide sounds in conjunction with game play and other EGM operations. EGM 100 further includes a top box 145 for displaying pay tables, artwork, advertising or other types of information either on fixed glass or on other displays such as an integrated video panel. Top box 145 may be fitted with a display device such as an LCD or plasma display to permit aspects of game play from either a base game or a bonus game to be shown in top box 145. Where the linked system includes one or more progressive jackpots, progressive meters may also be shown in top box 145 of EGMs connected to system server 200. Other meters 150 for tracking credits available for play and other amounts are positioned near the bottom of screen 110. A coin tray 155 at the bottom of EGM 100 is used to catch coins as they are dispensed to a player. It is also common for EGM 100 to include a ticket-in, ticket-out ("TITO") acceptor and printer components that may be integrated with a bill validator housed inside of EGM 100 for accepting bar coded credits through slot 120 and for which the value of the credits is displayed on meters 150 upon a ticket being inserted. In other systems, cashless mechanisms may be used for accepting and dispensing credits between players and the game accounting system. Certain of these systems may use smartcards, cellular phones, tablet computers or other personal electronic devices.

Other input devices on EGM 100 may include but not be limited to magnetic card readers, smart card readers, biometric reading devices, currency acceptors, input means for other financial devices, proximity detectors such as near field communications ("NFC") detectors, etc. for cashless transactions or other communications with many types of mobile electronic devices like smartphones. EGMs are of many variants and may include slots and video lottery terminals housed in upright, slant-top or other cabinet configurations. Secondary processing systems for bonusing and player tracking may be physically or logically integrated into EGMs. Such devices are produced by many companies, including IGT®, Aristocrat Technologies, Konami Gaming, WMS Gaming, Scientific Games, Bally Technologies, Rocket Gaming, Multimedia Games, and others.

In the RNG based EGMs 100*a* and 100*b*, game play results are generated internally at the particular EGM 100 and presented to the player. When a player initiates play of a game, a random number (or multiple numbers in a more complex game) is generated using RNG 320 within EGM 100*a* and a calculation is performed using that randomized value to generate a game result. In the case of a slot machine format game, the random number generated may result in position indicators for physical or virtual reels of symbols which are then displayed on display 105 and evaluated to determine any prize values. One or more of those values may correspond to a winning jackpot event. In that event EGM 100*a* hits a jackpot prize win, a message is generated and transmitted to system server 205 to inform system server 205 of the event. If the event is successfully validated by a process of procedural and/or automated checks, then system server 205 sends a reply message to EGM 100*a* confirming the jackpot win.

Alternatively, a central RNG generates random numbers or game results for two or more EGMs 100*a*. In this case, a central server of other device with RNG capabilities is used and is connected to two or more EGMs. For each game play on any connected EGM, a random number or game result is generated and provided to that EGM.

It is desirable that the communication between EGMs 100*c*1-6 at gaming venue C and system server 205 be substantially the same as the communication between the RNG based games 100*a*1-6 at gaming venue A and 100*b*1-6 at gaming venue B in the traditional gaming venues.

Figure 3:
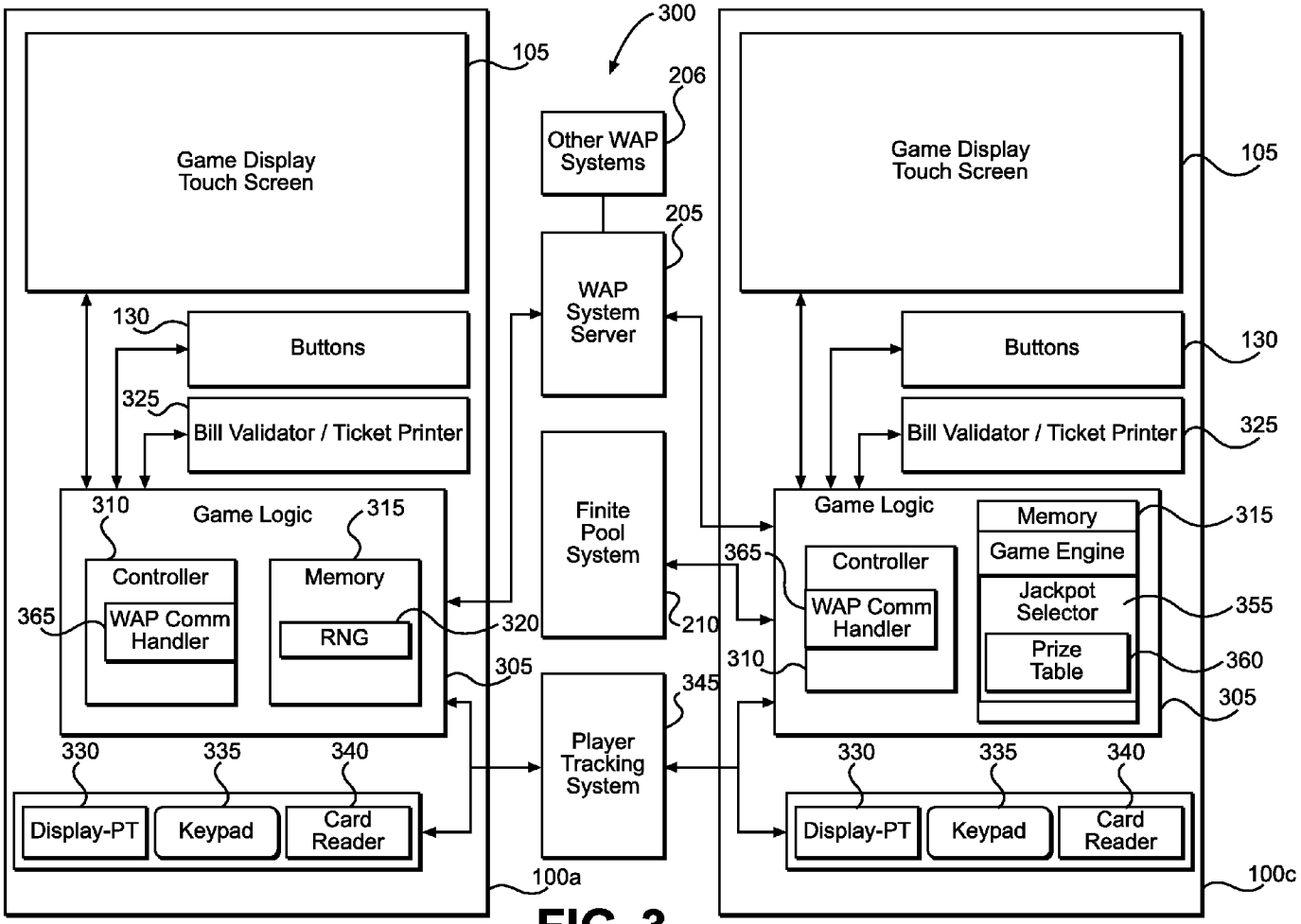
FIG. 3 is a block diagram of a wide area progressive system with optional links to additional wide-area progressive systems, connected to a combination of RNG-based and finite pool based EGMs showing details of the EGMs.

FIG. 3 is a block diagram 300 of a network in which a system server 205 is connected to a detailed view of an RNG-based EGM 100*a* such as those shown connected to linked system 200 in FIG. 2 at gaming venues A and B, and a similarly detailed view of finite pool based EGM 100*c* such as those connected to linked system 200 in FIG. 2 at gaming venue C. Game logic 305 in EGM 100*a* houses a controller 310 and a memory 315 for programs that define the logic and storage for temporary or non-volatile data for controlling operation of EGM 100*a* including a software based RNG 320. Touch screen display 105, buttons 130 and integrated bill validator/ticket printer 325 are connected to game logic 305 and permit a player to interact with EGM 100*a* during game operation. Player tracking components include a separate player tracking display 330, a keypad 335 and a card reader 340 that are connected to external player tracking system 345 for player interaction and play tracking on EGM 100*a*.

EGM 100*c* is similar to EGM 100*a*, however, EGM 100*a* has an internal RNG for determining game outcome while EGM 100*c* does not. Instead, EGM 100*c* is connected to finite pool system 210 so that it may receive game outcomes from finite pool system 210 as opposed to generating random numbers that are converted to game outcomes. For each game played on EGM 100*c*, a software based finite-pool gaming engine 350 residing in a player terminal of memory 315 retrieves a game result from finite pool system 210. A visual animation of the game play result for the player is displayed on display 105. The animation can reflect a winning game outcome or a losing game outcome depending on the game result retrieved from finite pool system 210.

Multiple game themes may be supported on one or more EGMs 100*c*, each of which game themes have their own set of pools with desired payout. For example, a given $1 game play on EGM 100*c* may have an actual prize payout percentage that is 90% of the amount played and a top prize of $5,000. That prize is won by lining up three "7s" in a straight line on display 105 that shows 3 spinning reels when the image of the three spinning reels comes to a stop. This would require a pool with at least one occurrence of a $5,000 winning result, as well as sufficient other plays (and prizes) so that when each pool was completed, 90% of the total amount wagered would be returned to the player in prizes and at least one prize of $5,000 would be won. An example of the contents of such a pool is reflected as:

| PRIZE | INSTANCES |
|---|---|
| $5,000 | 1 |
| $1,000 | 2 |
| $100 | 50 |
| $5 | 1,475 |
| No Win | 20,000 |

The example pool shown above has a size of 21,528 elements, with a purchase cost of $21,528 and prizes totaling $19,375 for an actual total payout of 90% and a top prize of $5,000. Over time, multiple instances of the pool will be anticipated. Each occurrence of the pool would have an equal payout percentage and distribution of prize sizes.

In one embodiment, play on one or more EGMs 100*c* would begin play from a single pool. When that pool is 50% depleted, a second pool instance is opened. The play would continue out of both pools according to an algorithm specifying the rotation of which EGM 100*c* is provided a pool element from a particular pool, until the second pool is 50% depleted, at which time a third pool is opened. The 50% depletion value is for exemplary description purposes and is not a requirement. In the model described there are generally two pools opened after the first pool is 50% exhausted. If the depletion value is set at 20%, for example, there would normally be five pools open at a given time.

It should be understood that many pools may be opened and in play simultaneously. By way of example, a system that supports 50 different slot-type game themes, where each game theme has five play denominations and a depletion value of 50%, would likely have approximately 500 individual pools open for play at any given time.

Finite pools can be ordered or unordered, depending on jurisdictional and/or technical requirements. In some embodiments, finite pools (game sets) may be further broken down into smaller "subsets." In one embodiment, finite pools are created by finite pool system 210. These initial finite pools each have a unique ID based on game theme, play denomination and instance. Finite pool system 210 is responsible for distribution of particular game results to EGMs 100*c*. On demand, finite pool system 210 may generate and manage pool subsets. In one embodiment, these subsets are in the range of 5,000 to 10,000 individual wager results. In this implementation, the subsets are ordered so that the sequence in which the play results will be distributed to individual EGMs 100*c* will be in a predetermined order. Finite pool system 210 will cache a small quantity of subsets for each active pool and dispense game results from those subsets in a manner consistent with the pool usage principles, and according to a predetermined algorithm.

According to the invention, a new software component called a jackpot selector is added to the finite pool EGM to equate the operation of a finite pool based EGM with that of an RNG based EGM. It is the addition of this component which causes the operation of a finite pool based EGM to behave in a way that allows statistical compatibility between the RNG based EGMs and finite pool based EGM that includes a jackpot selector. On each EGM containing a jackpot selector, referred to herein as a hybrid EGM, the jackpot selector 355 is programmed into memory 315. It is anticipated that finite pool system 210 will maintain more than one open pool at any given time. Each open finite pool maintained by finite pool system 210 that is in use in conjunction with WAP system 200 contains one or more results that specifies that the jackpot prize win is to be determined by jackpot selector 355. Jackpot selector 355 includes a prize table 360 that contains at least the various types of prizes and the probability of those prizes occurring. Using an internal RNG, jackpot selector 355 can randomly determine one of several types of possible wins from prize table 360 (but not necessarily the prize itself) including (but not limited to) a zero win, a win of a fixed prize, or a win of a linked prize from among one or more linked prizes that may include one or more progressive prize levels, or other prize. In the event of a progressive or other jackpot type prize the actual prize value may be determined by linked system 200 if not derived from the prize table.

When a linked prize type is determined by jackpot selector 355, the event will be passed to a linked communications handler or WAP communications handler 365 within controller 310 which will notify system server 205 of the win event. system server 205 will return the value of any linked prize won and initiate any validation processes which are required for linked system 200. A typical process would be to lock-up the machine with the winning prize while automated and/or manual security procedures are used to confirm the prize and initiate payment processes.

Figure 4:
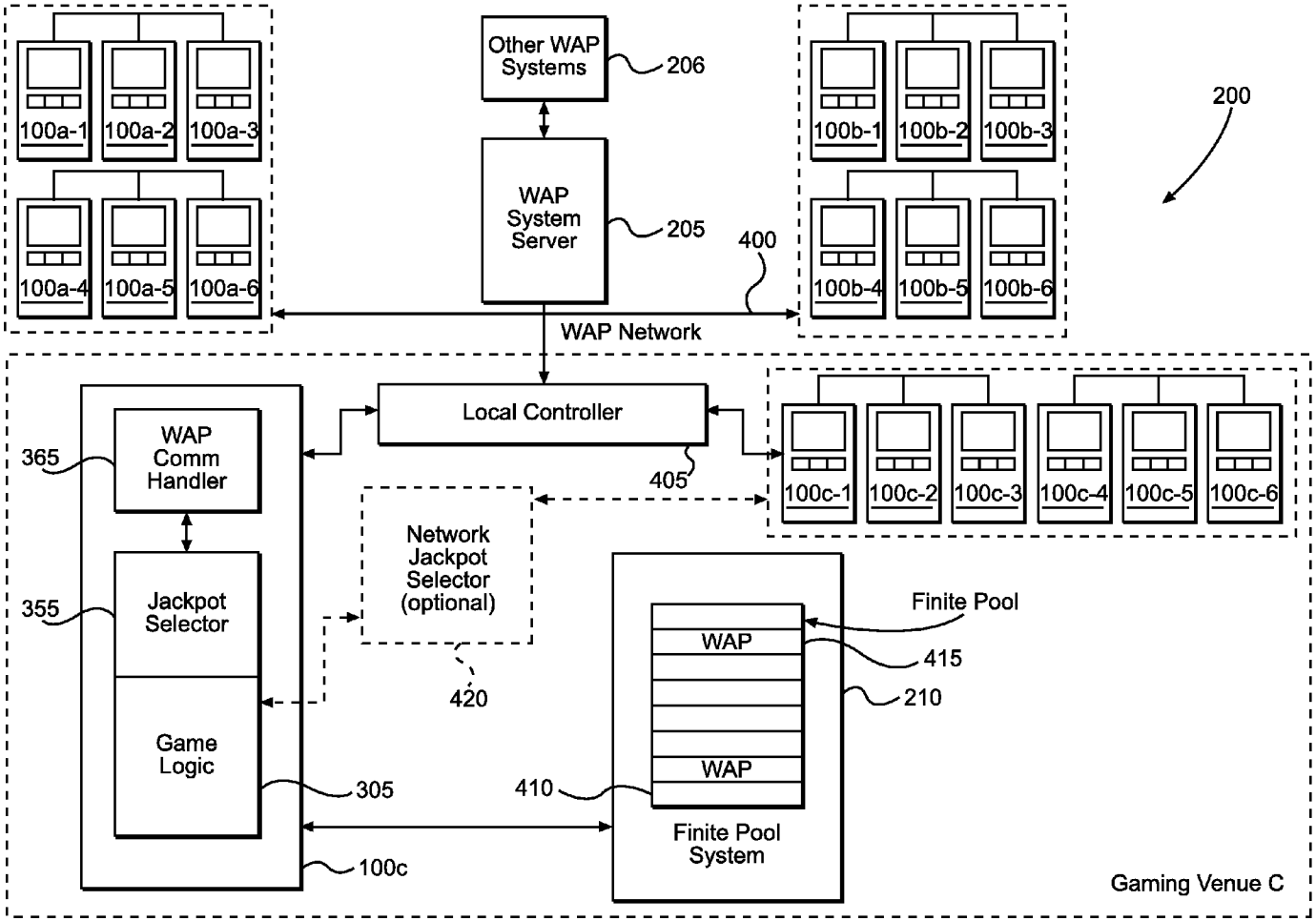
FIG. 4 is a block diagram of the WAP system network with optional links to additional wide-area progressive systems, connecting RNG-based EGMs, finite pool based EGMs, a finite pool system and a WAP system server.
Figure 5:
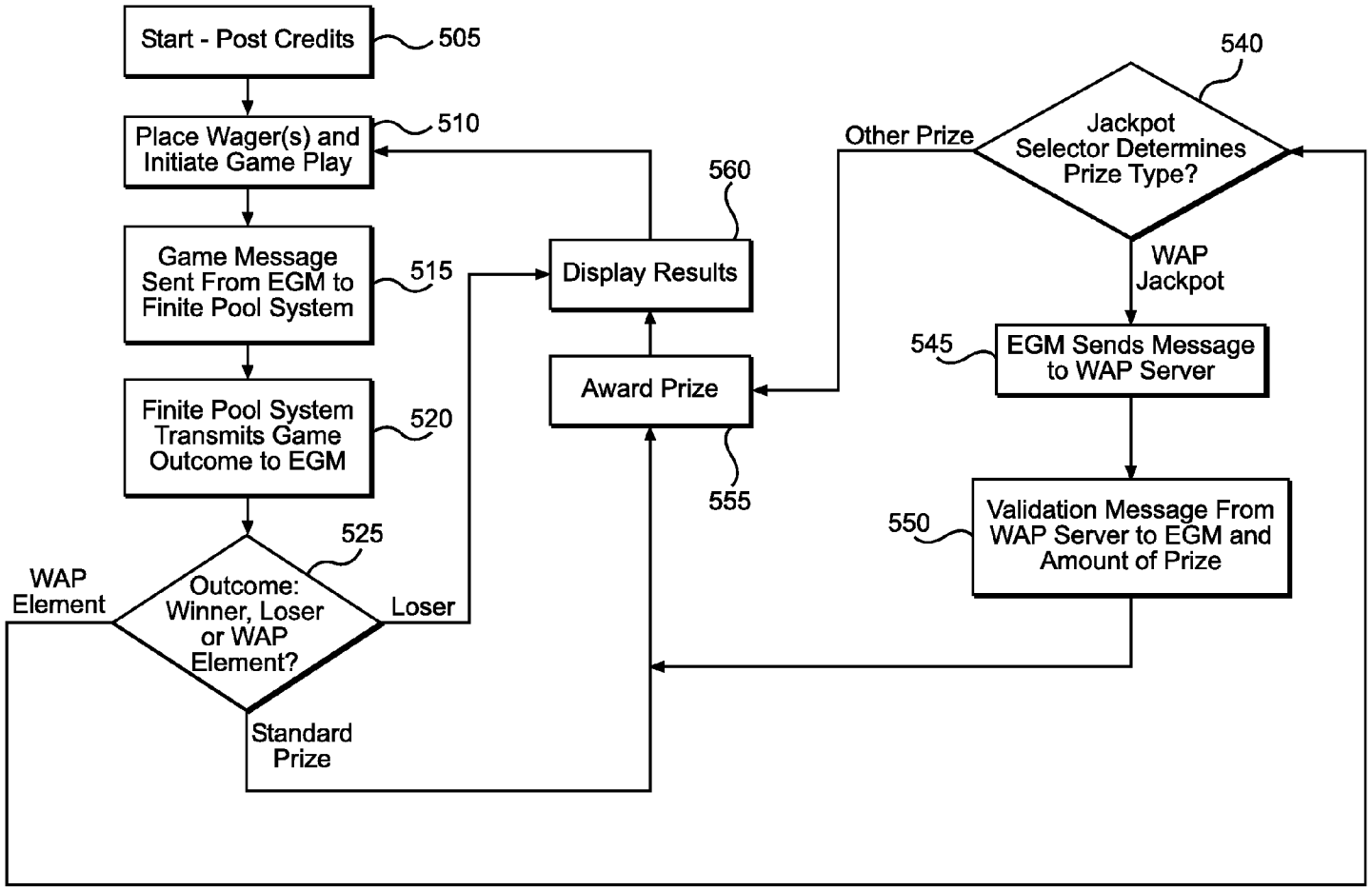
FIG. 5 is flow diagram of the operations occurring in a WAP system including hybrid EGMs, finite pool based EGMs, a finite pool system and a WAP system server with optional links to additional wide-area progressive systems.

FIG. 4 and FIG. 5 together illustrate in more detail the operational activity among and between EGM 100*c*, finite pool system 210 and system server 205 in linked system 200. For purposes of this description and throughout the specification and figures, reference will be made to a WAP system. However, it should be understood that any large-scale linked system network offering one or more large jackpots or prizes among a group of EGMs may be substituted for the WAP system. As can be seen in FIGS. 4 and 5, WAP system server 205 communicates with all EGMs 100*c* in a finite pool based gaming venue across a WAP network 400. WAP system 200 has a wide area network component (WAN) and a local area network component (LAN). It enables bi-directional communication between EGM 100*c* and WAP system server 205. WAP network 400 may optionally include a local controller or concentrator component 405 between WAP system server 205 and EGMs 100*c*, depending on the system architecture and communications methodologies as chosen by the manufacturer of WAP system 205. Local controller 405 is typically a microprocessor based computing device that routes communications between multiple EGMs 100*c* at a particular location and WAP system server 205 which may or may not be co-located with EGMs 100*c* and local controller 405 and may or may not assume some functions of WAP system server 205.

At EGM 100*c*, a player starts a session of play at EGM 100*c* by inserting currency in bill validator slot 120 or through another input to post credits on EGM 100*c* at step 505. A wager is then placed and game play is initiated as shown at step 510. At step 510, any relevant game parameters are also selected using the input devices on EGM 100*c*. Game parameters may include denomination of play, number of lines, card selections, and other elements as determined by the game theme being played. When conditions to allow game play are verified by the game logic a message is sent from EGM 100*c* to the finite pool system 210 at step 515. Finite pool system 210 would then respond by sending a message to EGM 100*c* containing a game outcome at step 520. The game outcome message would specify whether or not the game will result in a winner or loser, and if a winner whether it is a standard prize or a WAP prize at step 525. In the case of a winner, the prize value and other details about the prize would also be specified, such as whether it is a bonus. A standard winning outcome results in the prize being awarded to the player at step 555 in the form of credits being posted to the credit meter 150 on EGM 100*c*, the result of the game being displayed on display 105 at step 560, and the player being returned to step 510 to place a new wager and initiate another round of play. In the event of a losing outcome, the game result is displayed at step 560 and the player is returned to step 510 without a prize being awarded.

The finite pools to be used in conjunction with WAP play on EGM 100*c* will also have a newly defined WAP game play element 415. When selected by finite pool system 210 from a finite pool 410 at step 525, WAP game play element 415 will indicate that a selected result is a WAP element. Game play occurs normally in the system until WAP game play element 415 is selected from finite pool 410. In that case a WAP response message is returned to EGM 100*c* at step 520. Finite pool gaming engine 350 invokes jackpot selector 355 to make a determination on the type of jackpot prize that may result. In one implementation, the jackpot selection process is an internal process on EGM 100*c*. In an alternative embodiment, the jackpot selector may be implemented in an external network jackpot selector system 420, which is a component accessible to EGMs 100*c* communicating with each EGM 100*c* over a network. Such a component may be a stand-alone module or integrated into another element, such as finite-pool system 210. In either case, jackpot selector 355 or jackpot selector 420 determines if the wager in process wins a WAP jackpot, another prize or no prize at step 540. If a WAP jackpot is determined to be awarded, then EGM 100*c* receives the jackpot prize value from the WAP system server 205. Further, in the event of a large jackpot win such as a progressive prize, additional win processing steps may be required by the proprietary needs of the WAP system server or as required by the gaming jurisdiction according to local operating rules. Typical steps may be to lock the terminal up until the win is verified by manual or automated procedures.

In the event of a WAP jackpot being awarded to the player, EGM 100*c* informs WAP system server 205 of the winning event at step 545 and provides any of the play details that may be required as specified by the proprietary needs of WAP system server 205. Such information may include: time of game play event, wager amount, and other data. WAP system server 205 then validates the win and informs EGM 100*c* of the amount of the win which has been incrementing over time at step 550 and the progressive prize is awarded at step 555. The result is then processed by EGM 100*c* and information is presented to the player on display 105 at step 560 informing the player of the win and establishing procedures to claim the prize. Procedures may vary between systems provided by different WAP system suppliers or in different regulatory jurisdictions.

Going back to branching step 540, if jackpot selector 355 (or network jackpot selector 420) determines that the wager in process does not win a WAP jackpot at step 540, the selected prize is set at step 555 and displayed to the player at step 560. The player is then returned directly to step 510 where the game play process starts over with a new wager.

FIG. 6A illustrates a WAP jackpot selector table 600 of the type to be used by jackpot selector 355 or network jackpot selector 420 during the process of selecting a WAP jackpot. Table 600 resides in the data structure to determine the resulting prize of a selected game play where a WAP element was selected by finite pool system 210 and transmitted to EGM 100*c* at step 520. Table 600 is an array of n elements. Each element corresponds to a potential type of prize win that includes at least a type descriptor shown in a prize type column and a probability of occurrence shown in a probability column. Type descriptors may include, but are not limited to: a progressive win, a fixed value prize, and a non-winner. Some embodiments may support more than one type of progressive prize that may be available to be won by a player at the same time. Probabilities express the likelihood of each type of win occurring on a game play transaction. When jackpot selector 355 (or jackpot selector 420) initiates operation, a random number is generated. That random number is used in conjunction with the probabilities in WAP selector table 600 to select one of the prize types. The resulting prize type is then awarded to the player.

The process for generating random numbers by jackpot selector 355 (or jackpot selector 420) is well known in the gaming industry and is used as the basis for games currently operating either in an RNG-based EGM or a finite pool based system. The random number is converted to a prize type used in conjunction with the probabilities in WAP selector table 600 to select one of the table entries. The selection is a weighted selection, such that the event with the highest probability will be selected most often in proportion to the relative ratios of the probabilities.

FIG. 6B is a sample WAP jackpot selector table 610. As can be seen in table 610, three progressive prizes are offered with the top prize having a probability of being hit at 0.00001. The second tier prize has a probability of 0.0001 and the third tier prize has a probability of 0.001. A fixed prize of $50 has a probability of 0.01.

The jackpot selector values can be configured in combination with the number of WAP selector elements in a finite pool to achieve jackpot probabilities of any desired size. As an illustrative example, suppose that a jackpot probability of one in 100 million is desired. If a finite pool with 100 million elements is defined that includes 10,000 WAP selector elements and the probability of the jackpot occurring when the jackpot selector is executed is one in 10,000, then the probability of the jackpot occurrence on any game play will be one in 100,000,000.

What is important is that the number of entries to the jackpot selector, at all times over the life of the pools, remains high enough that "normal statistics" apply. This means that at least the number of entries never drops below approximately 20 while maintaining a higher number of entries being more desirable. As every entry is worth a fractional jackpot win, such as 0.0001 jackpots, both the probability of getting an entry and the probability of hitting the jackpot are "normally" distributed (Gaussian) random variables with no bias. During the first half of the first pool, the entries get depleted as the pool decreases, but stay statistically uniform with no bias. When combined with overlapping pools unbiased operation is continuous.

Figure 7:
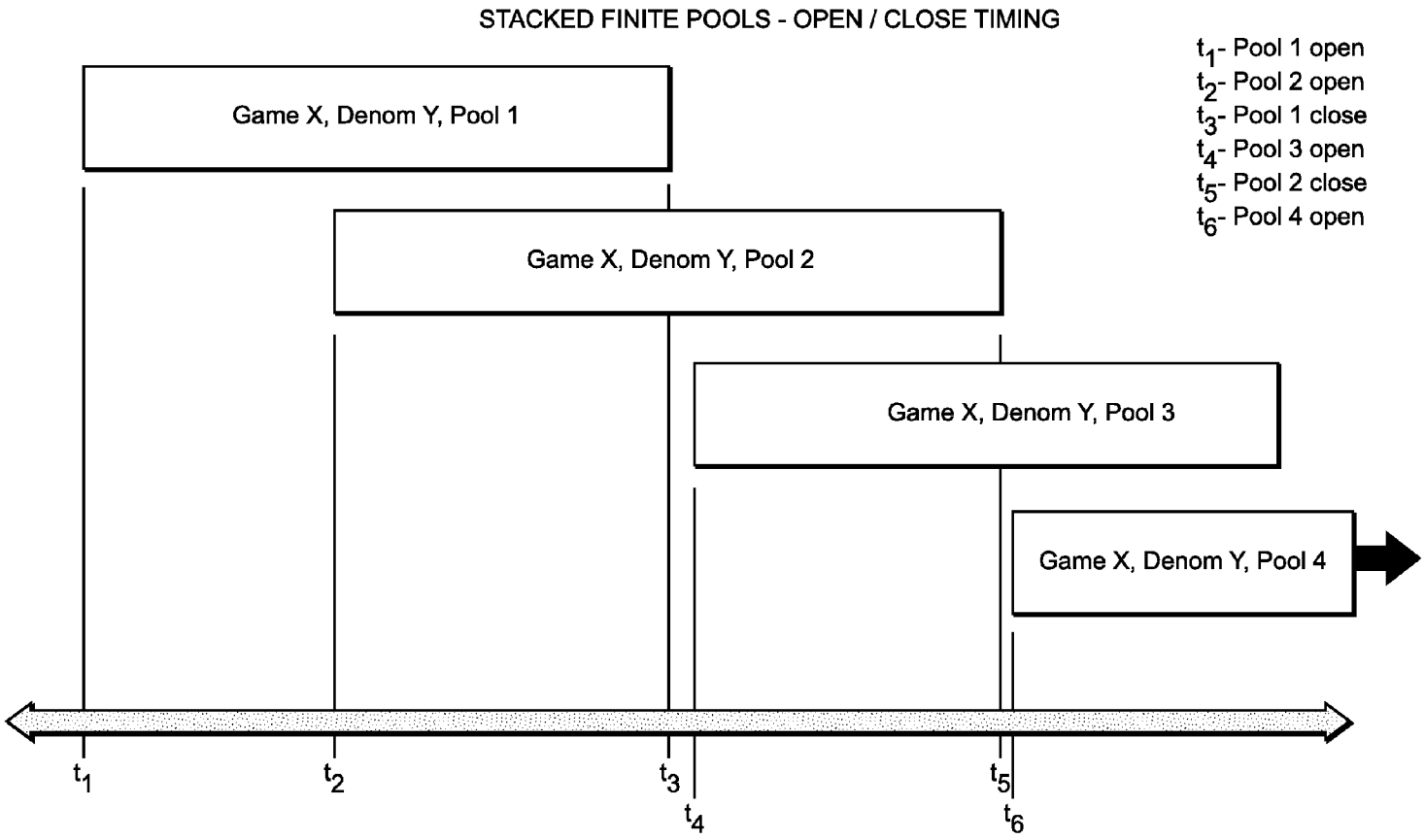
FIG. 7 is a timeline of multiple finite pools for use in a particular game.

FIG. 7 is a sample timeline of one embodiment of multiple finite pools for a particular game, Game X, of a particular denomination, Denomination Y, that open at different times along a timeline. As can be seen, a first pool, Pool 1 ($P_1$), is opened at time $t_1$ when Game X is introduced on a grouping of EGMs 100*c* in a gaming establishment. At time $t_2$, a second pool, Pool 2 ($P_2$), is opened while Pool 1 still has approximately ½ of the possible game outcomes remaining. By having two pools open, $P_1$ and $P_2$, the number and range of potential outcomes remaining available to players on EGMs 100*c* is increased. At time $t_3$, $P_1$ is closed and $P_2$ is the only pool remaining open. This is the case for a short time while there are still more than ½ of the possible outcomes remaining in $P_2$ and until $t_4$, at which time Pool 3 ($P_3$) is opened. At time $t_4$, $P_2$ is approximately ½ depleted and it is desirable to open $P_3$ so that the number and range of outcomes is again increased. At time $t_5$, $P_2$ is closed followed shortly thereafter at $t_6$ when Pool 4 is opened. The same pattern continues over time to ensure that a large number and range of outcomes is available to players, all the while making the operation of the system fair and transparent to players. It should be understood that while one or two pools are open at any given time in the example of FIG. 7, it's possible to implement pool operation with more pools being open for a particular game such as Game X from which to draw game outcomes.

Figure 8:
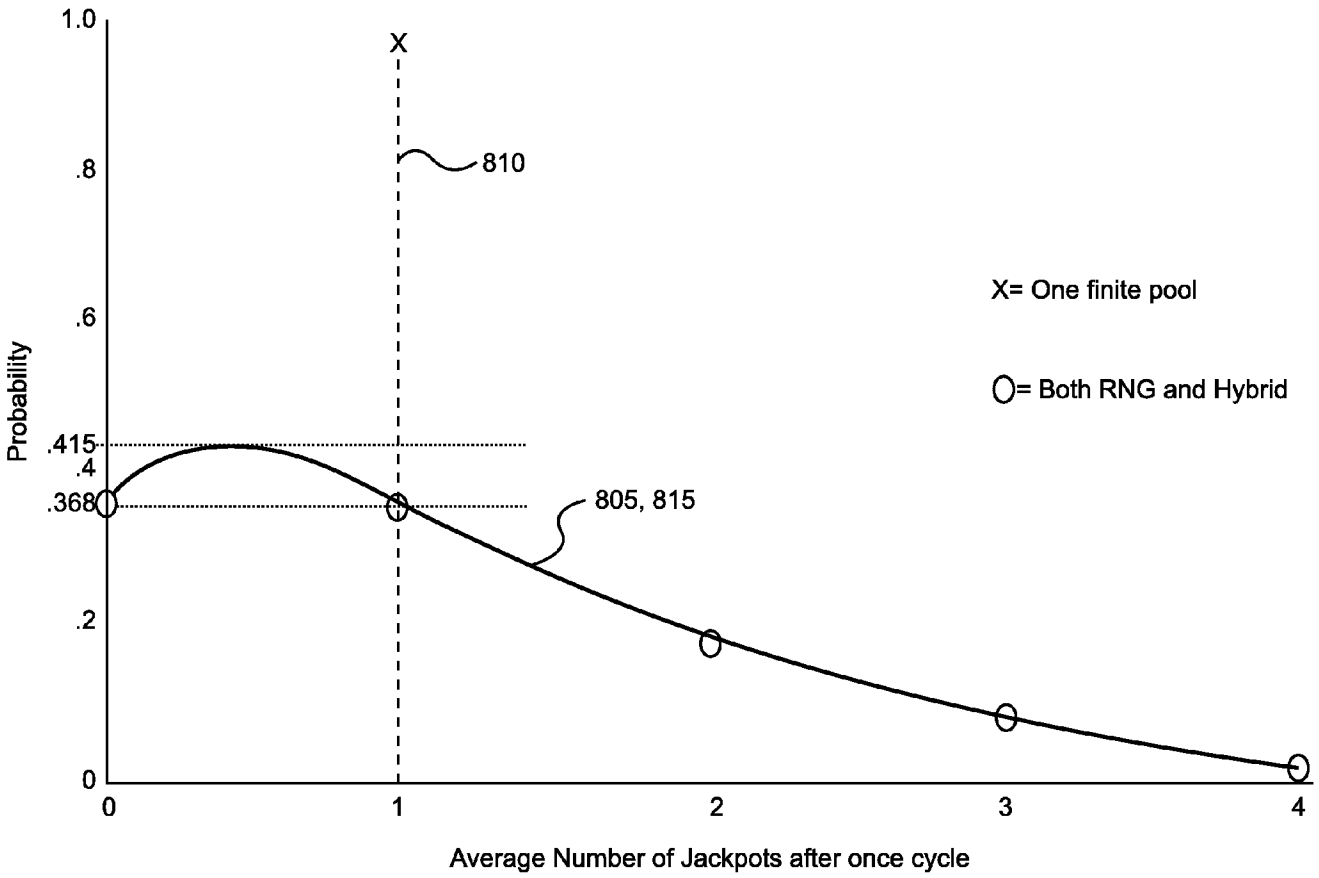
FIG. 8 is a chart showing the probability versus the average number of jackpots after one cycle of 50,000,000 plays.
Figure 9:
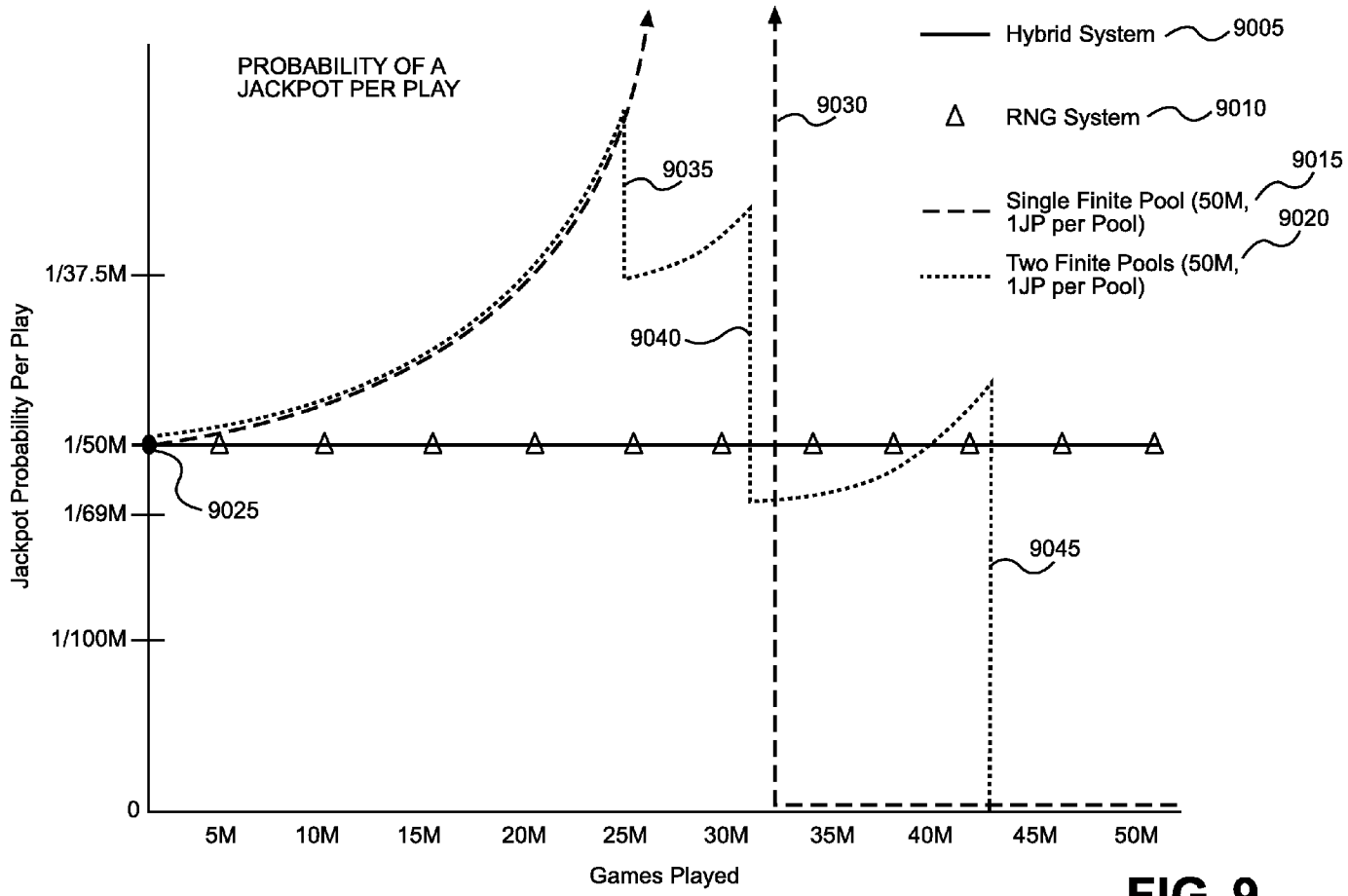
FIG. 9 is a chart showing the probability of a progressive jackpot being hit for each play of a particular game across different types of EGM systems.

FIG. 8 presents an example that shows that the expected number of jackpots in a play cycle is the same for hybrid EGMs and RNG based EGMs. It shows the probability of occurrence of various numbers of jackpots in 50,000,000 plays in a system with different EGM types including: (1) RNG based EGMs 805; (2) finite pool based EGMs operating with a single pool of 50,000,000 plays with one jackpot occurrence 810; and (3) hybrid EGMs operating using the same pool type 815. Although all three EGM types have a nominal probability of 1/50,000,000 of hitting the jackpot on the first play, it is clear that with the single, finite pool, exactly one jackpot is the only possibility, and this is reflected along the vertical dotted line, X. However, with the RNG based EGMs or the hybrid EGMs there is a finite probability that any number of jackpots, up to 50,000,000, can occur in the cycle of 50,000,000 plays. The chart, based on a Poisson distribution shown as the curved solid line, indicates probabilities of 0, 1, 2, 3, or 4 jackpots, with increasingly low probabilities as the number of jackpots increases beyond 4. The results for RNG based EGMs and hybrid EGMs are statistically identical FIG. 9 is a chart showing the probability of a jackpot per play as a function of the number of games played on the x-axis (horizontal) across a total of 50,000,000 plays and the probability of hitting a jackpot on the y-axis (vertical). It illustrates that while the probability of a jackpot occurrence may differ significantly over time with a finite pool system, the use of a hybrid EGM system as described herein produces a jackpot probability which is statistically indistinguishable from the constant jackpot probability characteristic of the RNG based EGM systems.

Four cases are identified:

1) A first set of values represented by line 9005 applies to a hybrid EGM system.
2) A second set of values represented by a line of triangular symbols 9010 applies to an RNG based EGM system.
3) A third set of values represented by first dashed line 9015 applies to a finite pool based EGM system in which a single pool of 50,000,000 plays contains a single jackpot occurrence.
4) A fourth set of values represented by second dashed line 9020 applies to a finite pool based EGM system with two finite pools, each pool with 50,000,000 plays, a single jackpot occurrence in each pool, with the second pool opening when the previous pool is 50% exhausted.

In all cases the probability on the first play of a game (a value of one on the x-axis) 9025 is 1/50,000,000. Note that the hybrid system line 9005 and the RNG based EGM system line 9010 each have a constant theoretical probability of 1/50,000,000 to win a jackpot on every play resulting in a horizontal line extending across the chart at the position of a probability of 1/50,000,000 on the y-axis. However, the probabilities change dramatically in the two finite pool implementations represented by lines 9015 and 9020.

In the case of single finite pool line 9015, the probability of a jackpot occurrence rises as the size of the pool containing the single jackpot occurrence depletes until the probability rises above the range of the y-axis. At some point, the single jackpot occurrence in that pool is played. In the example illustrated, this occurs at 32.5 million plays, and the probability of a further jackpot for line 9030 drops to zero as there are no more occurrences left in the open pool. The gap between the two distinct single finite pool lines 9030 reflects the fact that the probability rises to very high values as the pool depletes and the single jackpot occurrence has not been played. If, for example, the single jackpot occurrence were the last play in the pool of 50,000,000 plays, then the probability of picking it would be exactly "one" on the last play.

In the case with two finite pools line 9020 we see the probability of a jackpot occurrence rise as the initial pool depletes. When it is 50% depleted at point 9035, the probability drops because the second pool opens with a second jackpot opportunity, so the new probability base is 2/75,000,000 since there are now two jackpot occurrences remaining and 75,000,000 possible plays. Thereafter, the probability of the jackpot occurrence rises again as the two pools deplete until a first occurrence of a jackpot, for example, at point 31 million plays, shown occurring at line 9040. At that point, the probability of a second jackpot occurrence drops to 1/69,000,000, since there is one jackpot occurrence remaining in the 69 million plays remaining in the two open pools. After that point, the probability of the second jackpot occurring begins to rise as the number of plays remaining in the two pools depletes further. In the illustrative example, the second jackpot occurrence occurs after 43 million plays, indicated at line 9045. At that point, the probability of a third jackpot drops to zero since there are none left in the two initial pools.

This chart illustrates two examples, line 9015 and line 9020, of how the volatility of finite pools causes the probability of winning a jackpot to vary over time. It should be understood and recognized that the number of games played, the size of the pools and the probabilities may vary in any given finite pool system, however in all such cases the jackpot probability will vary over time. With the hybrid system the probability of a jackpot occurrence will be statistically identical to the constant RNG based EGM probability.

Figure 10:
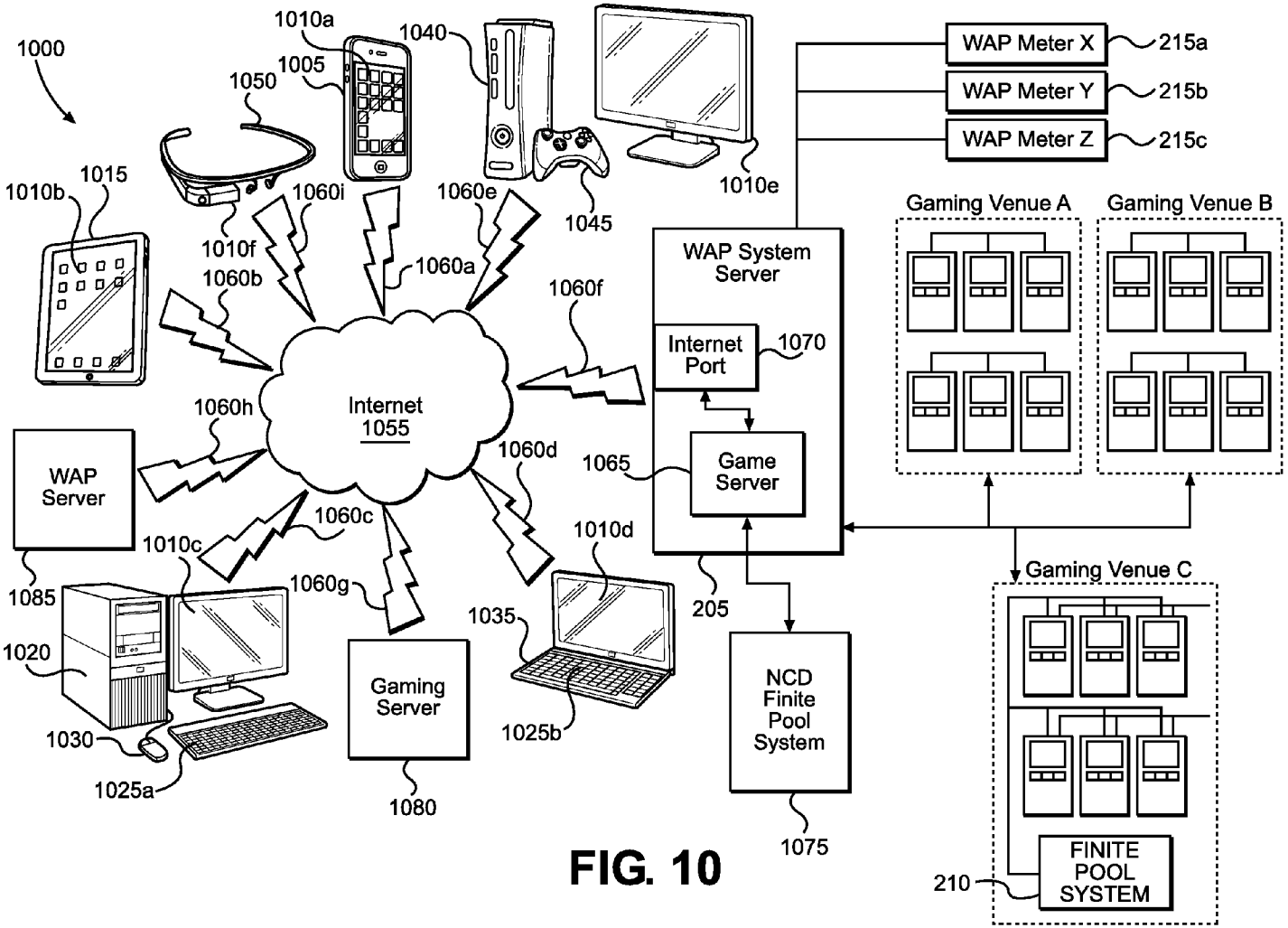
FIG. 10 is a block diagram of a wide area progressive system configured in a network with a combination of banks of RNG-based EGMs, finite pool based EGMs and other types of electronic devices that may be used to play games connected to a WAP system with optional links to other WAP systems.

FIG. 10 is a block diagram of a linked system that is a WAP system 1000 configured in a network with a combination of banks of RNG-based EGMs, finite pool based EGMs and other types of electronic devices that may be used to play games connected to a WAP system. WAP system 1000 operates in the same manner as the WAP system of FIG. 2 with respect to the EGMs 100*a-c* at gaming venues A-C. In the embodiment shown in FIG. 10, a number of EGMs are shown in the form of other types of general network computing devices ("NCDs") that may be used to participate in games that are eligible to win a progressive jackpot on WAP system 200. It should be understood that any NCD described herein is simply another type of EGM that may substituted for an EGM previously described herein. In many instances it may be a client-server configuration where the gaming logic is resident in a gaming server 1080 which controls game outcomes and prizes. Such systems may integrate progressive prizes by interfacing to WAP system server 205, or by integrating a hierarchy of linked servers that may be, for example WAP servers represented by WAP server block 1085.

In one embodiment, NCDs will act as clients to game server 1065 or game server 1080 which provide gaming, accounting and other services for client devices. Game server 1080 is an independent game server and is connected to internet 1055 to deliver games over network connection 1060*g*. Similarly WAP server 1085 may be an independent WAP server that is connected to internet 1055 to deliver WAP games and services over internet 1055 over network connection 1060*h*.

The NCDs shown include a smartphone 1005 which may be an APPLE iPhone 4S® as pictured, or any other mobile phone type device and including a touchscreen display 1010*a*. A tablet computer 1015 which may be an APPLE iPad 3® as pictured, or any other tablet computing device and including a touchscreen display 1010*b*. A desktop computer 1020 which may be a LENOVO® machine as pictured, or any other desktop computer and including a screen 1010*c*, a keyboard 1025 and a mouse 1030. A laptop computer 1035 which may be a LENOVO® computer or any other laptop computer including a screen 1010*d*, a keyboard 1025*b*and a trackpad. A home video gaming device 1040 which may be a MICROSOFT XBOX® system or any other home video system and including a controller 1045 and a screen 1010*e*. A wearable computer 1050, which may be a GOOGLE® GLASS device or other wearable or implanted device.

Other types of NCDs could also be used to play games on a system including portable video gaming devices such as a Sony PSP®, a Nintendo GameBoy®, or an internet connected television with a browser or app capabilities. Any of these devices is capable of playing a game, including a wagering game, through an app loaded onto the device or through a website accessible using a browser on the device. In the case of the networked game, payment may be made by credit card, Paypal®, points such as loyalty points, or another form of credit, points or payment service.

Game display screen 1010 on an NCD may be of any type including but not limited to a flat screen liquid crystal display ("LCD"), a screen using light emitting diode ("LED") technology, a cathode ray tube ("CRT") or any other kind of screen for displaying images. The screen may include a touch screen feature such as that included on a laptop, an iPhone or an iPad that provides a flexible interface for operation of a NCD, but it is not required and it should be understood that many NCDs such as an Xbox, as well as many desktops and laptops do not include touch screens. As an alternative, or as a supplement to a touch screen, the NCDs may include other input devices such as a keyboard 1025 shown with desktop computer 1020 or laptop computer 1035, buttons such as those for use on a game play console 1045 like an Xbox, a trackpad or any other suitable input device, or a voice activated, voice recognition input system.

Any of the NCDs of FIG. 10 are capable of participating in linked system play when connected directly to system server 205 or when game server 1065, 1080 are connected to WAP system server 205. In addition to conducting the linked game, which is a wide area progressive system game as shown, WAP system server 205 may also include a game server 1065 capable of delivering one or more games through an internet port 1070 over a network such as internet 1055. Alternatively, game server 1065 may be configured separately and networked to internet 1055 at the same or in a different location as WAP system server 205. Each NCD is connected over a network link 1060*a-e* and 1060*i* with WAP system server 205, including game server 1065 connected over link 1060*f*. All operational functions of game server 1065 are controlled by one or more controllers which are typically microprocessors housed inside WAP system server 205. The controllers also provide either a central RNG that can supply game outcomes to NCDs connected to WAP system server 205, or alternatively, game server 1065 may draw RNGs from a NCD finite pool system 1075 operating in a manner similar to the operation of finite pool system 210 described herein and pass them to a particular NCD upon request. The use of one or more central game servers 1065 to deliver game content, game outcomes and other data to a player is well known to those of ordinary skill in the art. In the case of any of the NCDs, random number generation is handled securely on game server 1060 (or at NCD finite pool system 1075) and the resulting outcome is then delivered over internet 1055 to be displayed on the particular NCD. In this way, the integrity of the process for generating random numbers is maintained and may not be compromised by hacking into a local RNG on a particular NCD.

It will be understood that the type of network over which data is communicated can be one of several different types of networks. This includes a Local Area Network (LAN), Wide Area Network (WAN), an intranet or the Internet as depicted in FIG. 10. Other proprietary networks could also be used without departing from the principles of the invention. This would include such networks as a Windows network or an Ethernet network.

It should also be understood that while WAP server 1085 and WAP system server 205 may control independent WAP systems, they may also act in concert in a hierarchal fashion such that one may integrate progressive prizes that may be integrated into a higher level progressive prize.

The principles of this invention additionally apply to a wider class of prizes than the various types of progressive prizes used to describe the invention herein. As stated above and for example, large or very large fixed or variable prizes, or bonuses that are best implemented across a linked network including large numbers of EGMs have all the problems described with respect to progressive prizes, and the solutions presented herein equally apply to those other types of prizes.

While the invention has been described with respect to the figures, it will be appreciated that many modifications and changes may be made by those skilled in the art without departing from the spirit of the invention. Any variation and derivation from the above description and drawings are included in the scope of the present invention as defined by the claims.

What is claimed is:

1. A networked wagering system, comprising:

at least one linked jackpot available to be awarded for play of the networked wagering system;

a finite pool system including a finite pool system processor that determines game outcomes from a set of finite pool game outcomes including one or more winning outcomes and one or more losing outcomes, wherein at least one of the winning outcomes has an associated active linked game play element that results in an opportunity to win one of the linked jackpots;

a plurality of finite pool electronic gaming machines ("EGMs") connected to the finite pool processor, wherein each finite pool EGM receives game outcomes including game outcomes with the associated active linked game play element that results in an opportunity to win one of the linked jackpots;

a plurality of random number generator ("RNG") EGMs operating independently of the finite pool system, wherein each RNG EGM is configured with an independent random number generator ("RNG") that generates random numbers corresponding to a set of game outcomes including one or more winning outcomes and one or more losing outcomes, and further wherein at least one of the winning outcomes results in the award of one of the at least one linked jackpots;

a jackpot selector in communication with the finite pool system processor and the plurality of finite pool EGMs, and configured to determine a random jackpot value awarded upon the finite pool system processor providing the active linked game play element to a finite pool EGM wherein the random jackpot value awarded is selected from a group of awards including the at least one linked jackpot, and further wherein the jackpot selector is set to predefine the probability of winning the at least one linked jackpot to be statistically equivalent to the probability of the at least one linked jackpot being awarded to an RNG EGM among the plurality of RNG EGMs; and a linked jackpot controller interface configured to output the random jackpot value awarded to a particular finite pool EGM.

2. The system of claim 1 wherein the finite pool system includes an independent random number generator ("RNG") that is a central RNG that provides random numbers to two or more EGMs in the plurality of finite pool EGMs.

3. The system of claim 1 wherein the linked jackpot is from among the group comprising: (a) one or more fixed jackpot awards; (b) one or more progressive jackpot awards; or (c) an award of one or more service or merchandise items.

4. The system of claim 1 wherein the random jackpot value awarded is determined by a process external to EGMs in the plurality of finite pool EGMs.

5. The system of claim 1 wherein the finite pool system processor determines game outcomes using a random number generator ("RNG").

6. The system of claim 1 wherein the RNG based EGMs each include an independent RNG that is resident in each RNG EGM.

7. The system of claim 1 wherein the probability of winning the linked jackpot on any of the finite pool EGMs on any given play of a game is substantially equal.

8. The system of claim 1 wherein if an outcome on a finite pool EGM is determined to be a winning outcome, the jackpot selector selects among a linked jackpot, another award or no award.

9. The system of claim 8 wherein a weighting is applied to a set of probabilities for the linked jackpot, other awards or no award with the probability of winning the linked jackpot being smaller than the probability of winning other awards or no award.

10. A method of operating a networked wagering system, comprising:

providing at least one linked jackpot awarded for play of the networked wagering system;

configuring a finite pool system in the networked wagering system including a finite pool system controller and a plurality of finite pool electronic gaming machines ("EGMs");

determining game outcomes on the finite pool system controller from a set of finite pool game outcomes generated by the finite pool system controller including one or more winning outcomes and one or more losing outcomes, wherein at least one of the winning outcomes has an associated active linked game play element that results in an opportunity to win one of the linked jackpots on the finite pool EGMs;

providing game outcomes to the finite pool EGMs including game outcomes with the associated active linked game play element that results in an opportunity to win one of the linked jackpots;

configuring a plurality of random number generator ("RNG") based EGMs operating independently of the finite pool system, wherein each RNG based EGM is configured with an independent random number generator ("RNG") that generates random numbers corresponding to a set of game outcomes including one or more winning outcomes and one or more losing outcomes, and further wherein at least one of the winning outcomes results in the award of one of the at least one linked jackpot;

providing a jackpot selector in the finite pool system in communication with the finite pool system controller and the plurality of finite pool EGMs;

using the jackpot selector to award a random jackpot value to a particular finite pool EGM receiving the active linked game play element, wherein the random jackpot value awarded for the winning outcome is selected from a group of awards including the at least one linked jackpot, and further wherein the jackpot selector is set to predefine the probability of winning the at least one linked jackpot to be statistically equivalent to the probability of the at least one linked jackpot being awarded to an EGM among the plurality of RNG-based EGMs; and outputting the random jackpot value awarded to the particular finite pool EGM from a linked jackpot controller interface in the finite pool system.

11. The method of claim 10 wherein the finite pool system includes an independent random number generator ("RNG") that is a central RNG that provides random numbers to two or more finite pool EGMs.

12. The method of claim 10 wherein each EGM in the plurality of RNG EGMs includes an independent random number generator.

13. The method of claim 10 wherein the linked jackpot is from among the group comprising: (a) one or more fixed jackpot awards; (b) one or more progressive jackpot awards; or (c) an award of one or more service or merchandise items.

14. The method of claim 10 wherein the random jackpot value awarded is determined by a process external to the finite pool EGMs.

15. The method of claim 10 wherein the finite pool system processor determines game outcomes using a random number generator ("RNG") for the plurality of finite pool EGMs.

16. The method of claim 10 wherein the RNG EGMs each include an independent RNG.

17. The method of claim 10 wherein the probability of winning the linked jackpot on any of the finite pool EGMs on any given play of a game is substantially equal.

18. The method of claim 10 wherein if an outcome on a finite pool EGM EGMs is determined to be a winning outcome, the jackpot selector selects among a linked jackpot, another award or no award.

19. The method of claim 18 wherein a weighting is applied to a set of probabilities for the linked jackpot, other awards or no award with the probability of winning the linked jackpot being smaller than the probability of winning other awards or no award.

* * * * *